US006376812B2

(12) United States Patent
Yamada et al.

(10) Patent No.: US 6,376,812 B2
(45) Date of Patent: Apr. 23, 2002

(54) COOKING APPLIANCE WITH INFRARED SENSOR HAVING MOVABLE FIELD OF VIEW

(75) Inventors: Morito Yamada, Kusatsu; Kazuo Taino, Shiga; Kiyoshi Hiejima, Moriyama; Haruo Sakai, Hikone; Hiroyuki Uehashi, Shiga, all of (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 09/840,185

(22) Filed: Apr. 24, 2001

(30) Foreign Application Priority Data

Apr. 26, 2000 (JP) ..... 2000-125476

(51) Int. Cl.[7] ..... H05B 1/02

(52) U.S. Cl. ..... 219/492; 219/497; 219/502; 219/711; 219/412; 99/329 R; 99/331; 374/121; 374/149

(58) Field of Search ..... 219/711, 492, 219/494, 497, 501, 506, 411, 412, 413; 99/329 R, 325, 331–335, 121, 129; 374/149

(56) References Cited

U.S. PATENT DOCUMENTS 5,744,786 A * 4/1998 Kim ..... 219/711
5,893,051 A * 4/1999 Tomohiro ..... 702/130
5,938,959 A * 8/1999 Wang ..... 219/401
6,158,329 A * 12/2000 Schneider et al. ..... 99/331

* cited by examiner

*Primary Examiner*—Mark Paschall
(74) *Attorney, Agent, or Firm*—Armstrong, Westerman, & Hattori, LLP

(57) ABSTRACT

In a sake/milk heating process, the field of view of an infrared sensor is moved by a predetermined pattern in a heating chamber as an initial search. When the field of view is fixed after the initial search, if the temperature variation of an object within the field of view after a predetermined time has passed is equal to or lower than a specified value, various determinations are made, and the field of view of the infrared sensor is again moved in the heating chamber as a re-search. Thus, even if the field of view is fixed at a position where no food item is placed for some reason in the initial search, the field of view will not be fixed in the incorrect position and can be moved again.

20 Claims, 13 Drawing Sheets

FIVE-LINE SEARCH

THREE-LINE SEARCH

COOKING APPLIANCE WITH INFRARED SENSOR HAVING MOVABLE FIELD OF VIEW

BACKGROUND OF THE INVENTION

1. Field of the Invention

The present invention relates to a cooking appliance such as a microwave oven, and more particularly, to a cooking appliance with an infrared sensor having a field of view within a heating chamber.

2. Description of the Background Art

Some of the conventional cooking appliances were provided with infrared sensors capable of detecting the temperature of food within heating chambers. In such a cooking appliance, the field of view of the infrared sensor was fixed to a position determined that the food was placed thereat, once the field of view started to move through the entire heating chamber simultaneously with the start of the heating. In the cooking appliance, the temperature of an object within the field of view was continuously or intermittently detected after the field of view was fixed, and the heating was stopped when the detected temperature reached the temperature at which the heating should be terminated.

It is noted that, in fixing of the field of view, the position assumed to have the food thereat was determined as follows. That is, the temperature is detected by moving the field of view to a plurality of points in the heating chamber, and a point at which the difference in the temperature between the point and the peripheral points is equal to or higher than a predetermined value is selected from the plurality of points. Thus, the selected point was determined as the position where the food exists.

However, in the conventional cooking appliance, when heating of a food item is carried out, for example, immediately after another food item was heated to a high temperature, even if the "position where food exists" was incorrectly determined due to the partially raised temperature in the heating chamber, the heating operation would be continued in a state where the field of view was fixed at the incorrectly-determined position, i.e. where no food item exists in the field of view of the infrared sensor. Therefore, the cooking appliance could not surely grasp the temperature of the food item, which made it difficult to automatically control the progress of the heating of the food item.

SUMMARY OF THE INVENTION

The present invention was made in view of the foregoing, and it is an object of the present invention to provide a cooking appliance capable of including a food item placed in a heating chamber within a field of view of an infrared sensor.

A cooking appliance according to the present invention includes a heating unit heating an object to be heated; a heating chamber containing the object to be heated; an infrared sensor having a field of view within the heating chamber and detecting an amount of infrared radiation within the field of view; a field of view moving unit moving the field of view of the infrared sensor; and a temperature detecting unit detecting a temperature of an object within the field of view based on a detection output of the infrared sensor. The field of view moving unit is characterized by executing a first movement control moving the field of view by a predetermined pattern within the heating chamber simultaneously with or after a start of a heating operation of the heating unit; fixing the field of view at a predetermined position, which is a position having a temperature difference relative to a periphery equal to or higher than a predetermined value within the heating chamber, or a position having a largest temperature difference relative to the periphery within the heating chamber, in a detection temperature of the temperature detecting unit in the first movement control; and again executing a second movement control moving the field of view within the heating chamber based on satisfaction of a predetermined condition, after fixation of the field of view at the predetermined position.

Further, a method of controlling a cooking appliance according to an aspect of the present invention is made for a cooking appliance including a heating unit heating an object to be heated, a heating chamber containing the object to be heated, and an infrared sensor having a field of view within the heating chamber. The method of controlling includes the steps of executing a first movement control moving the field of view by a predetermined pattern in the heating chamber simultaneously with or after a start of a heating operation; detecting a temperature within the field of view, based on a detection output of the infrared sensor during a period in which the first movement control is being executed; determining a predetermined position, which is a position having a temperature difference relative to a periphery equal to or higher than a predetermined value within the heating chamber, or a position having a largest temperature difference relative to a periphery within the heating chamber, in a temperature within the field of view during the period in which the first movement control is being executed; fixing the field of view at the predetermined position; and executing a second movement control again moving the field of view within the heating chamber, based on satisfaction of a predetermined condition during a period in which the field of view is being fixed at the predetermined position.

According to the present invention, even if the field of view of the infrared sensor is once moved and fixed at the position determined to have the food item thereat as a result of the first moving control, the field of view can be moved again in the heating chamber if the predetermined condition is satisfied.

Therefore, the position of the field of view of the infrared sensor can be changed even after the field of view is once fixed at a position that was incorrectly determined to have the food item. This can more reliably avoid the situation in that the heating operation is continued in a state where no food item is included within the field of view of the infrared sensor.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

A microwave oven will be described below as an embodiment of a cooking appliance according to the present invention, with reference to the drawings.

1. Structure of Microwave Oven

Figure 1:
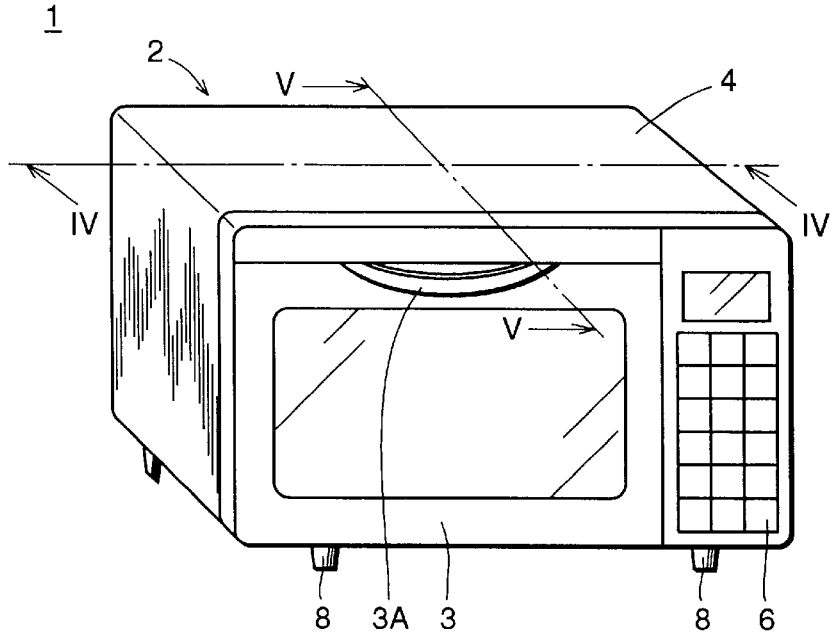
FIG. 1 is a perspective view of a microwave oven of an embodiment of the present invention.

Referring to FIG. 1, a microwave oven 1 is mainly constituted by a main body 2 and a door 3. Main body 2 is covered with a housing unit 4. An operation panel 6 for the user to enter various kinds of information to microwave oven 1 is provided on the front face of main body 2. It is noted that main body 2 is supported by a plurality of legs 8.

Figure 2:
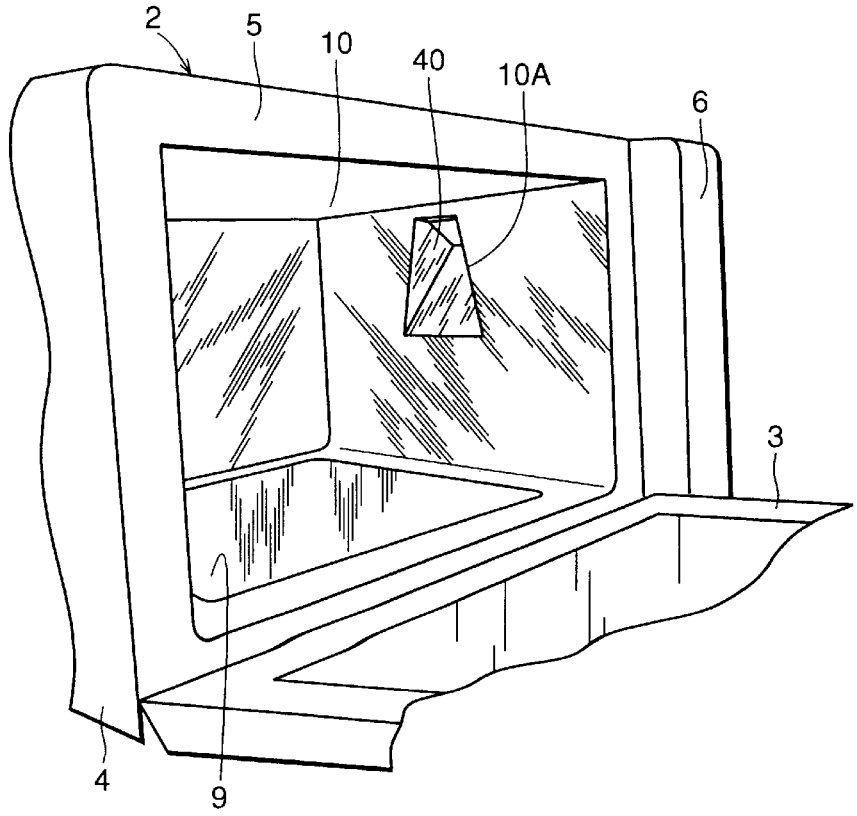
FIG. 2 is a perspective view of the microwave oven shown in FIG. 1 with a door opened.

Door 3 is formed such that it can be opened and closed with its lower end fixed. Door 3 has a handle 3A at the upper portion thereof Further, referring to FIG. 2, a body frame 5 is provided inside main body 2. Body frame 5 defines a heating chamber 10. Heating chamber 10 has a hole 10A in the upper portion of its right sidewall. A detection path member 40 is connected to hole 10A from the outside of heating chamber 10. A bottom plate 9 is provided at the bottom face of heating chamber 10.

Figure 3:
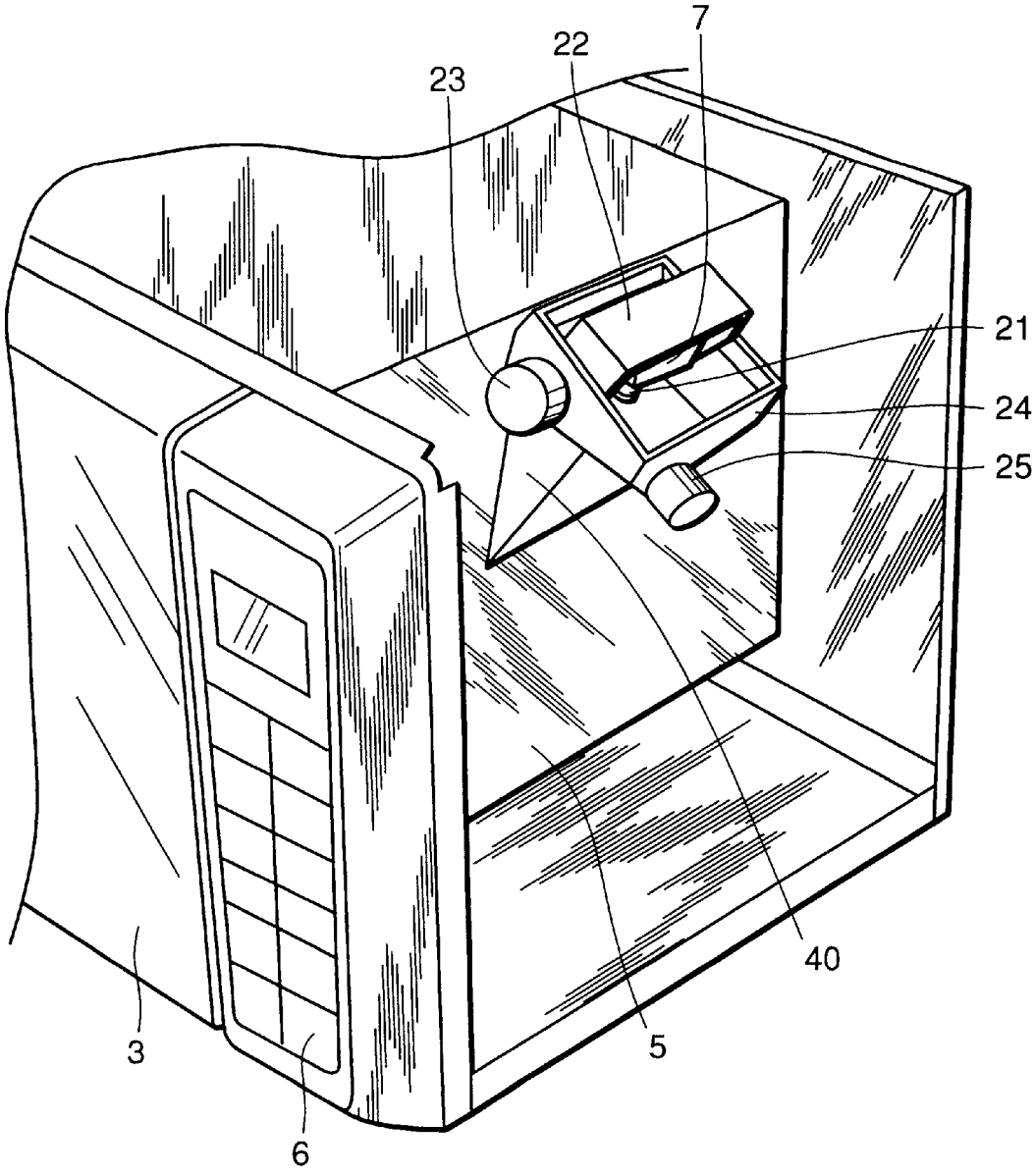
FIG. 3 is a perspective view of the microwave oven shown in FIG. 1 without its housing.

Though various kinds of parts, such as a magnetron 12 (see FIG. 4), are mounted on the right side of body frame 5 to be adjacent to heating chamber 10, they are not shown in FIG. 3.

Figure 4:
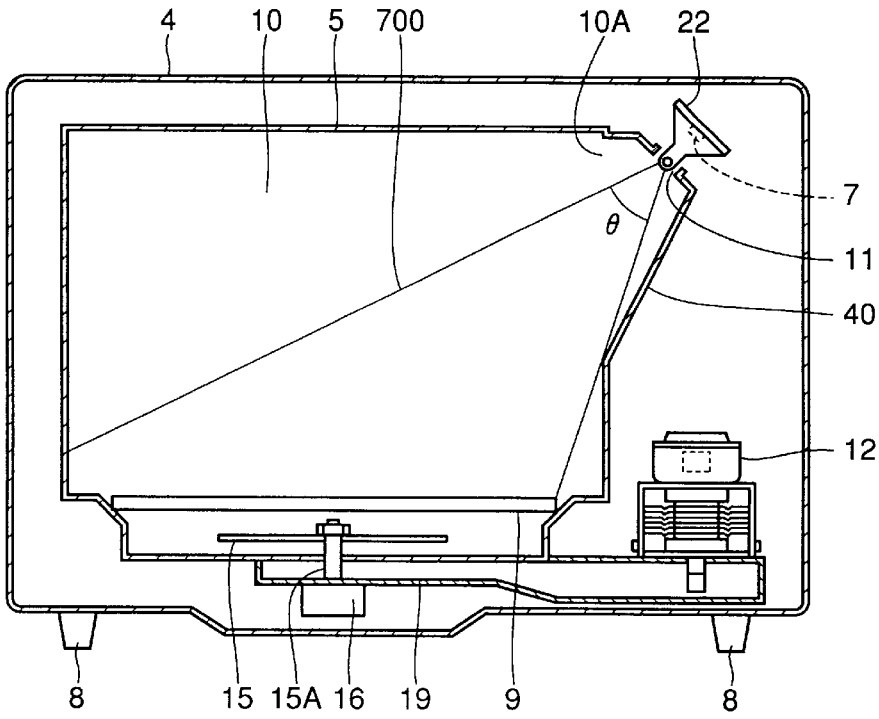
FIG. 4 is a section view of the microwave oven shown in FIG. 1 taken along line IV—IV in the direction of the arrow.
Figure 5:
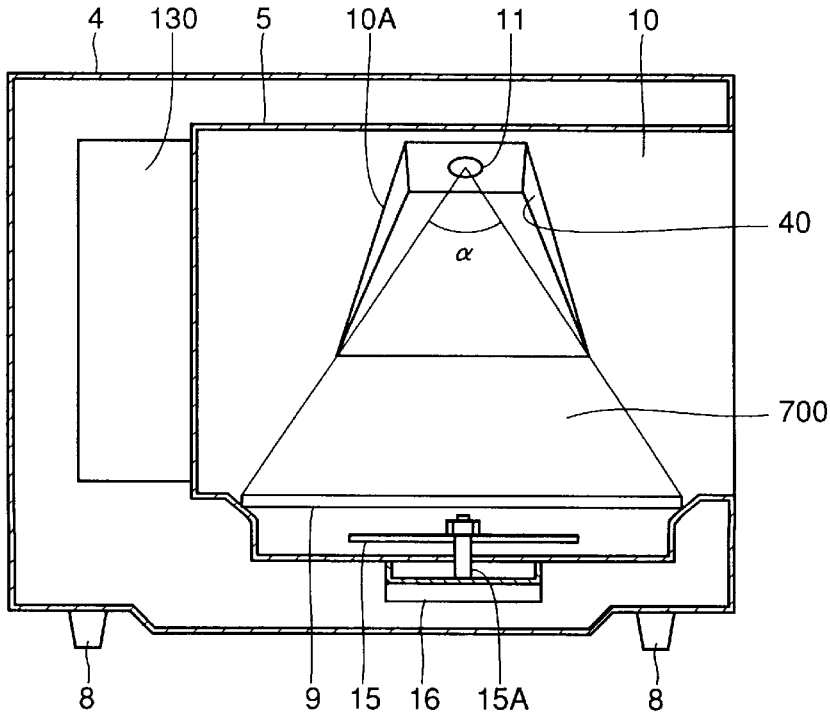
FIG. 5 is a section view of the microwave oven shown in FIG. 1 taken along line V—V in the direction of the arrow.

Referring to FIGS. 3 to 5, detection path member 40 connected to hole 10A has an opening, and has a shape of a box with the opening connected to hole 10A. It is noted that detection path member 40 has an infrared sensor 7 mounted on the bottom surface of the box. A detection window 11 is formed at the bottom surface of the box constituting detection path member 40, i.e., at a portion facing a detection hole 21 of infrared sensor 7.

A magnetron 12 is provided within housing unit 4 so as to be adjacent to the lower right portion of heating chamber 10. A wave guide 19 connecting magnetron 12 to the lower portion of body frame 5 is provided under heating chamber 10. The magnetron 12 supplies microwaves into heating chamber 10 through wave guide 19.

A rotatable antenna 15 is provided between bottom plate 9 and the bottom of body frame 5. An antenna motor 16 is provided under wave guide 19. Rotatable antenna 15 and antenna motor 16 are connected to each other by a shaft 15A. Antenna motor 16 is driven to rotate rotatable antenna 15.

A food item is placed on bottom plate 9 in heating chamber 10. The microwaves emitted from magnetron 12 is supplied into heating chamber 10 though wave guide 19 while being stirred by rotatable antenna 15. Thus, the food item on bottom plate 9 is heated.

Further, a heater unit 130 is provided at the backside of heating chamber 10. Heater unit 130 contains a heater 13 which will be described later, and a fan for efficiently feeding the heat generated from heater 13 into heating chamber 10. It is noted that, though not shown in the drawings, a heater (a heater 14 which will be described later) is provided also at the upper part of heating chamber 10.

Infrared sensor 7 is provided with detection hole 21 for catching infrared radiation. Infrared sensor 7 has a field of view. In microwave oven 1, X- and Y-axes are defined on the bottom surface of heating chamber 10. The field of view of infrared sensor 7 can be moved in the directions of the X- and Y-axes.

An X-direction pivot member 22 and a Y-direction pivot member 24 are mounted to infrared sensor 7. An X-direction pivot motor 23 and a Y-direction pivot motor 25 are mounted to infrared sensor 7. X-direction pivot motor 23 is driven to allow X-direction pivot member 22 to move the field of view of infrared sensor 7 in the direction of the X-axis. Further, Y-direction pivot motor 25 is driven to allow Y-direction pivot member 24 to move the field of view of infrared sensor 7 in the direction of the Y-axis.

Thus, infrared sensor 7 can include a substantially entire region of the bottom surface of heating chamber 10 within field of view 70. In FIGS. 4 and 5, the maximum range within which the field of view moves in heating chamber 10 is indicated as a total field of view 700. That is, referring particularly to FIG. 4, the field of view moves in the direction of the X-axis so as to draw a triangle having an apex at detection window 11, a base at bottom plate 9 and an apex angle of $\theta$. Further, referring particularly to FIG. 5, the field of view also moves in the direction of the Y-axis so as to draw a triangle having an apex at detection window 11, a base at bottom plate 9 and an apex angle of $\alpha$.

Figure 6A:
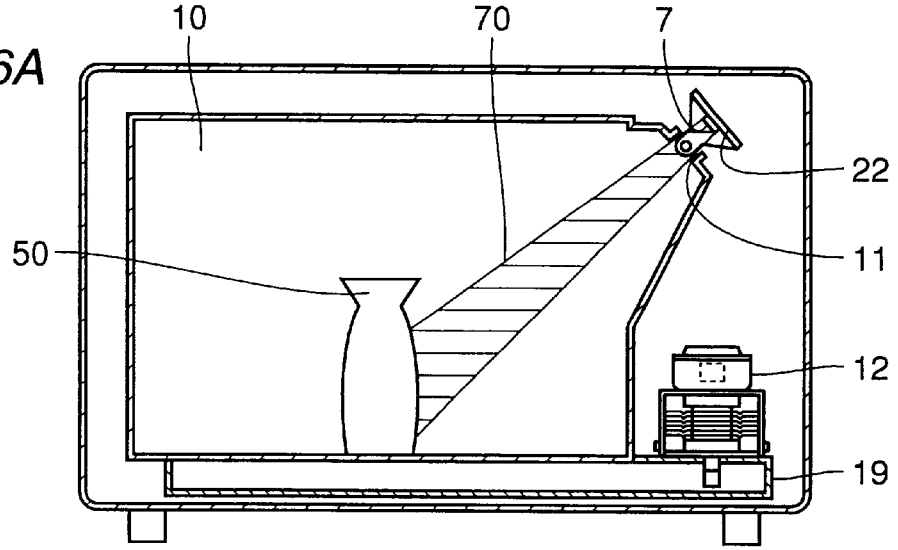
FIGS. 6A–6C are schematic section views of the microwave oven shown in FIG. 1 taken along line I—IV in the direction of the arrow.
Figure 6B:
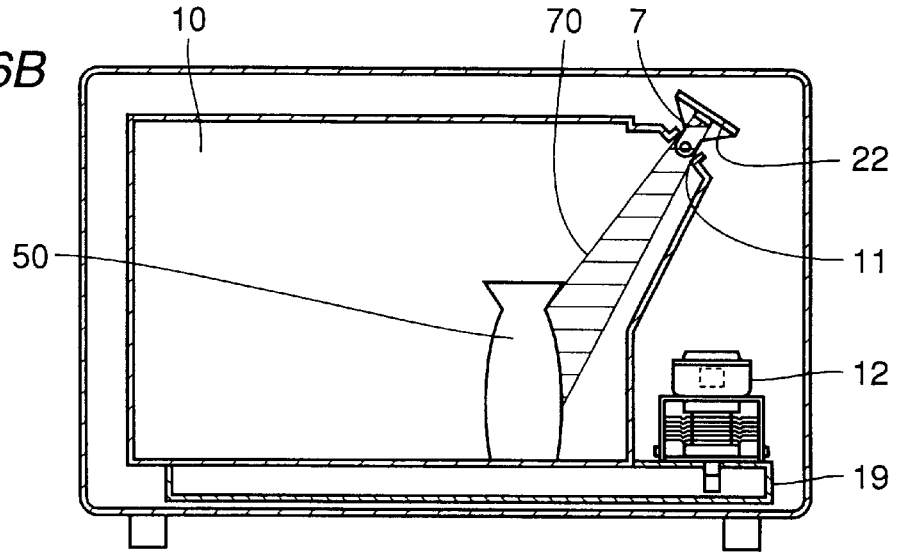
Figure 6C:
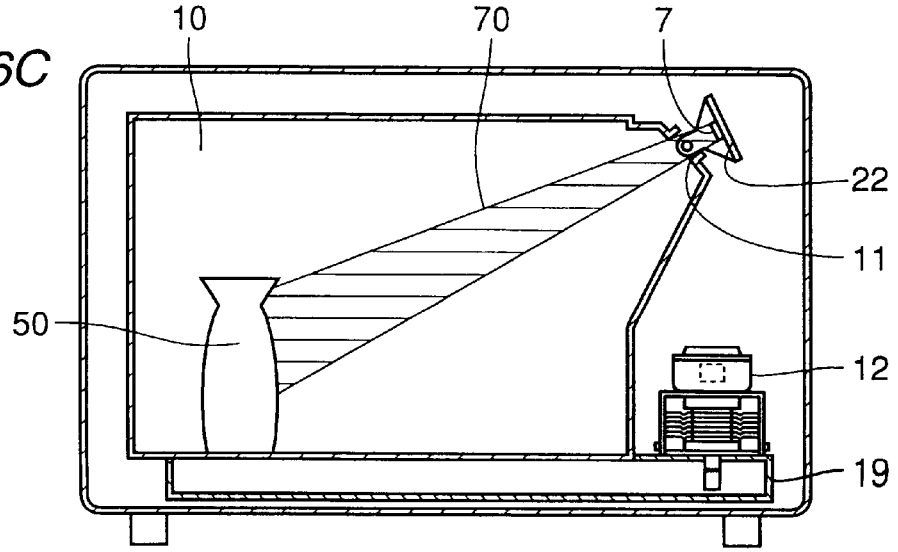

Referring now to FIGS. 6A to 6C, the moving manner of the field of view of infrared sensor 7 is described in more detail.

When X-direction pivot motor 23 is driven, field of view 70 of infrared sensor 7 moves in the width direction of heating chamber 10 along with the movement of X-direction pivot member 22, as shown in FIGS. 6A to 6C. Note that field of view 70 pivotally moves about detection window 11 formed in heating chamber 10.

It is noted that field of view 70 also moves in the depth direction of heating chamber 10 as Y-direction pivot member 24 moves. Also in this case, field of view 70 pivotally moves about detection window 11. As such, field of view 70 pivotally moves about detection window 11 when one or both of X-direction pivot member 22 and Y-direction pivot member 24 is/are moved. Such a movement of field of view 70 allows the area of detection window 11 to be minimum and prevents leakage of the microwaves supplied to heating chamber 10 to the outside.

Figure 7:
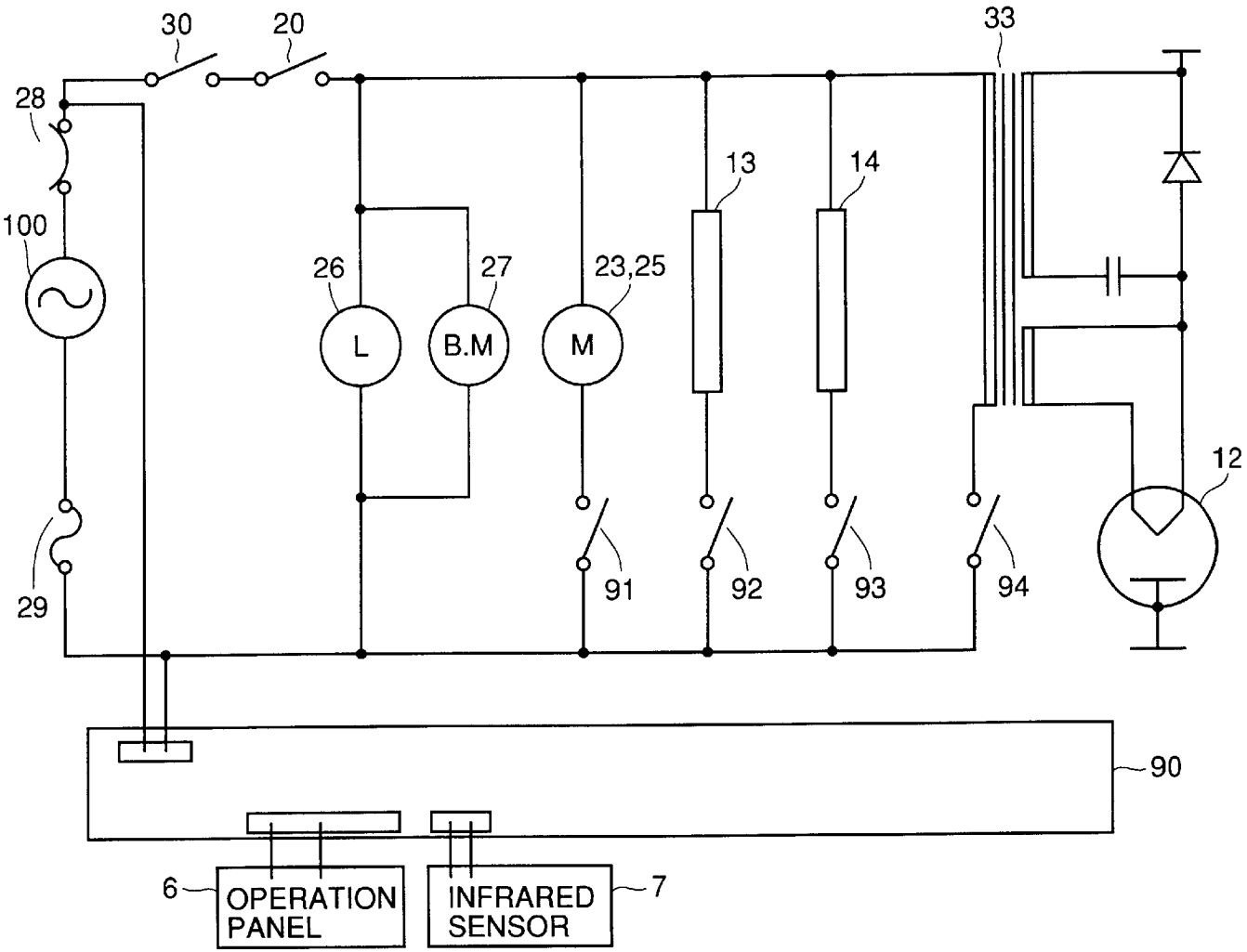
FIG. 7 schematically shows the electrical configuration of the microwave oven shown in FIG. 1.

FIG. 7 schematically shows an electrical configuration of microwave oven 1. Microwave oven 1 is provided with a control circuit 90 which generally controls the operation of the microwave oven 1. Control circuit 90 includes a microcomputer.

Control circuit 90 receives various kinds of information from operation panel 6 and infrared sensor 7. Further, control circuit 90 controls opening and closing of relay switches 20 and 91 to 94, to control the operations of magnetron 12, heaters 13, 14, X-direction pivot motor 23, Y-direction pivot motor 25, an oven light 26 and a cooling fan motor 27. Note that oven light 26 is a light for illuminating inside of heating chamber 10. Cooling fan motor 27 is a motor driving a fan for cooling magnetron 12. Further, a high-voltage transformer 33 is provided to supply a high voltage to magnetron 12. Heater 13 is installed in heater unit 130. Heater 14 is installed at the inner top surface of heating chamber 10 in order to brown the food item.

Moreover, microwave oven 1 is connected to an AC power supply 100 supplying electric power to the microwave oven 1 via a temperature fuse 28 and a fuse 29. Furthermore, microwave oven 1 includes a door switch 30. Door switch 30 is configured to open the circuit shown in FIG. 7 when door 3 is opened and to close the circuit shown in FIG. 7 when door 3 is closed. When door switch 30 opens the circuit, the power feeding from AC power supply 10 to magnetron 12 is made impossible. This can reliably avoid a dangerous situation such that magnetron 12 issues microwaves when door 3 is open.

2. Movement Pattern of Field of View of Infrared Sensor

In microwave oven 1, four patterns of the movement pattern of the field of view of infrared sensor 7 are respectively defined as "five-line search", "three-line search", "central area search" and "five-vertical-line+one-horizontal-line search." Here, referring to FIGS. 8 to 11, the manner movement will be described for each of the four patterns. It is noted that the central position of the field of view of infrared sensor 7 is denoted as a central position 70A in FIGS. 8 to 11.

(1) Five-Line Search

Figure 8:
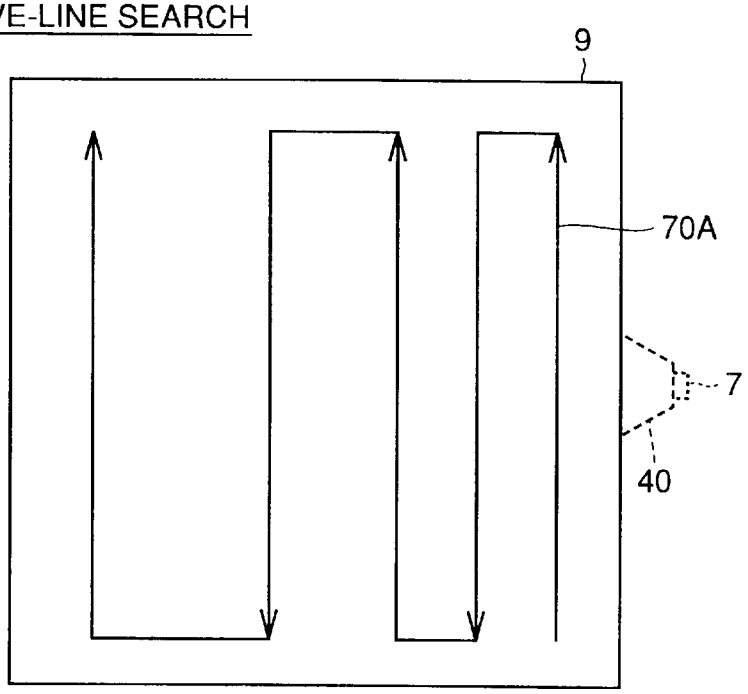
FIG. 8 shows a movement manner of the field of view of the infrared sensor of the microwave oven shown in FIG. 1 when it is moved by a "five-line search"

In the "five-line search" shown in FIG. 8, central position 70 of the field of view of infrared sensor 7 is moved along the arrows. Specifically, central position 70A first moves from the right-front corner to the backside of heating chamber 10, and to the left at the backside of heating chamber, subsequently to the front, then to the left at the front part of heating chamber 10, then to the backside, and again to the left at the back of heating chamber 10. Thereafter, central position 70A moves again to the front and again to the left at the front side of heating chamber 10, and then further toward the backside.

In the "five-line search," five scans are carried out in the direction of the depth of heating chamber 10. Further, in the heating chamber 10, an X-axis is defined in the width direction and a Y-axis is defined in the depth direction. If the values of the coordinates are arranged at regular intervals on each axis on bottom plate 9, the leftmost arrow on bottom plate 9 of the arrows indicating the five scans in the depth direction can be defined as a line of X=0, whereas the rightmost arrow thereof can be defined as a line of X=17. In this case, the five arrows in the depth direction of heating chamber 10 shown in FIG. 8 are defined as lines of X=0, 6, 11, 14 and 17, respectively in the order from the leftmost. This means that the five arrows described above are not arranged at regular intervals. This is due to the fact that the patterns formed by projection of the field of view of infrared sensor 7 onto bottom plate 9 are different from each other by the distance between infrared sensor 7 and bottom plate 9.

(2) Three-Line Search

Figure 9:
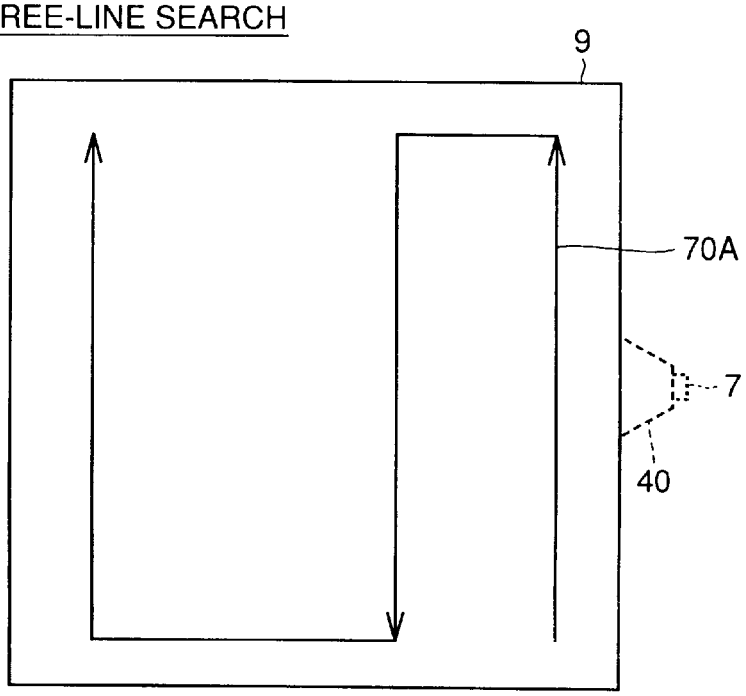
FIG. 9 shows a movement manner of the field of view of the infrared sensor of the microwave oven shown in FIG. 1 when it is moved by a "three-line search"

In the "three-line search" shown in FIG. 9, central position 70A of the field of view of infrared sensor 7 is moved along the arrows. Specifically, central position 70A moves from the right-front corner to the backside of heating chamber 10, then to the left at the backside of heating chamber, then to the front, and to the left at the front part of heating chamber 10, and thereafter to the backside.

In the "three-line search," three scans are carried out in the depth direction of heating chamber 10. The leftmost arrow on bottom plate 9 of the arrows indicating the three scans in the depth direction can be defined as the line of X=0, whereas the rightmost arrow thereof can be defined as the line of X=17. In this case, the arrows in the direction of the depth of heating chamber 10 can be defined as X=0, 11 and 17, respectively in the order from the leftmost.

(3) Central Area Search

Figure 10:
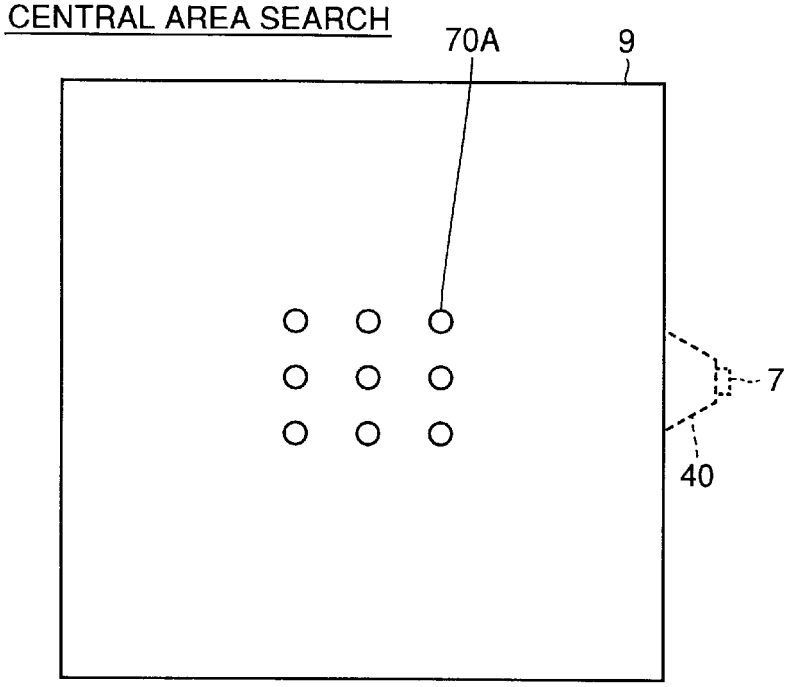
FIG. 10 shows a movement manner of the field of view of the infrared sensor of the microwave oven shown in FIG. 1 when it is moved by a "central area search"

In the "central-area search" shown in FIG. 10, central position 70A of the field of view of infrared sensor 7 is moved to the positions indicated by nine circles in a predetermined order. This means that the temperature is detected by infrared sensor 7 at the nine spots in the vicinity of the center of heating chamber 10 in this search.

It is noted that the X-Y coordinates of nine central positions 70A in the "central area search" can be represented as follows. First, as for the X coordinate, the moving range of central position 70A in the X-direction is defined as X=0 to 17 in FIGS. 8 and 9. As for the Y coordinate, the moving range of central position 70A in the Y-direction is defined as Y=0 to 17 in FIGS. 8 and 9. It is noted that the moving limit in the direction of depth of heating chamber 10 is defined as Y=0. By using thus defined X-Y coordinate system, the X-Y coordinates of the nine central positions 70A in the "central area search" can be represented by (9, 9), (9, 11), (9, 13), (11, 9), (11, 11), (11, 13), (13, 9), (13, 11) and (13, 13), respectively.

(4) Five-Vertical-Line+One-Horizontal-Line Search

Figure 11:
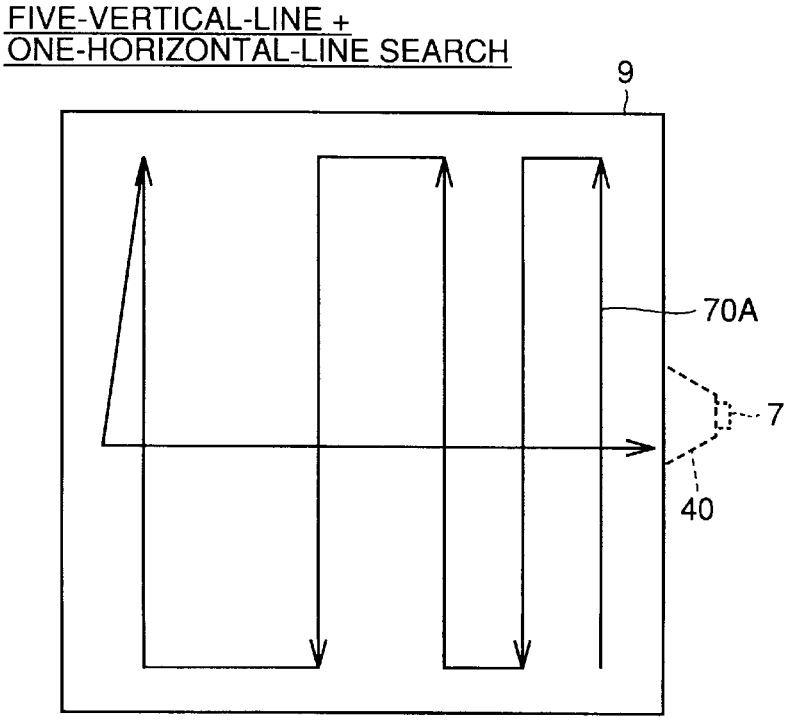
FIG. 11 shows a movement manner of the field of view of the infrared sensor of the microwave oven shown in FIG. 1 when it is moved by a "five-vertical-line+one-horizontal-line search"

In the "five-vertical-line+one-horizontal-line search" shown in FIG. 11, after the "five-line search" described above, the field of view of infrared sensor 7 moves from the left to the right as indicated by Y=10 in the X-Y coordinate system defined in FIG. 10.

(5) Cooking Menu and Movement Pattern of Field of View

Microwave oven 1 can perform automatic cooking in accordance with several kinds of cooking menus. The cooking menus include five kinds of menus such as "sake (Japanese liquor)/milk heating," "heating," "rice," "leaf/fruit vegetable" and "root vegetable." It is noted that the cooking menus are entered from operation panel 6 by the user.

Further, in microwave oven 1, the field of view of infrared sensor 7 is fixed at a position determined to have a food item placed thereat, from when the movement of the field of view started simultaneously with the heating by magnetron 12, usually until the heating of the food item is terminated.

Hereinafter, the movement of the field of view from the start of the heating until the fixing of the field of view as described above will be referred to as "initial search" in the present specification. Further, even if the field of view of infrared sensor 7 is once fixed after the initial search, it may be moved again in some cases, depending on the detection output of infrared sensor 7 with its field of view fixed. Such movement of the field of view of infrared sensor 7 is called "re-search."

Table 1 shows details on each of the cooking menus and the movement manners of the field of view in the "initial search" and in the "re-search." Note that "5-line" indicated in Table 1 means the "five-line search" described with reference to FIG. 8. Similarly, "3-line" and "5-vertical + 1-horizontal" means "three-line search" and "five-vertical-line+one-horizontal line search" described with reference to FIGS. 9 and 11, respectively.

In the menus except for the menu of "root vegetable," the re-search is carried out until a temperature detected based on the detection output of infrared sensor 7 reaches a preset temperature. The preset temperature is the temperature at which the heating should be terminated. The preset temperature is set independently for each cooking menu. It is noted that the heating by magnetron 12 is terminated together with the movement of the field of view when the temperature detected based on the detection output of the infrared sensor 7 reaches the preset temperature.

TABLE 1

| Menu | Sake/Milk Heating | Heating | Rice | Leaf/Fruit Vegetable | Root Vegetable |
|---|---|---|---|---|---|
| Cooking Details | Heating of Food Item in Bottle or Cup | Heating of Food Item on Plate | Heating of Rice in Bowl | Precooking of Leaf/Fruit Vegetable | Precooking of Root Vegetable |
| Initial Search | 5-Line | 3-Line | 3-Line if Detection of Food Failed in Central Area Search | 5-Vertical + 1-Horizontal if Detection of Food Failed in Central Area Search | 5-Line |
| Re-Search | 5-Line | 3-Line | 3-Line | 5-Vertical + 1-Horizontal | 5-Line per certain period |
| | Continue Search Until Preset Temperature is Detected | | | | Return Field of View to Fixed Position of Initial Search After Re-Search |

Referring to Table 1, when the cooking is carried out in accordance with, for example, the menu of "sake/milk heating," the five-line search is executed as an initial search simultaneously with the start of the heating by magnetron 12, and thereafter the field of view is fixed to a position that was determined to include the food item thereat. Subsequently, in general, the temperature within the field of view is detected based on the detection output of infrared sensor 7 while the field of view is still fixed, and then the heating is terminated when the detected temperature reaches the preset temperature. Whereas, if a predetermined condition is satisfied while the field of view is fixed after the initial search, the movement of the field of view is continued as a re-search, using the pattern of the five-line search. The temperature within the field of view is also detected continuously based on the detection output of the infrared sensor 7 during the re-search, and the movement of the field of view is terminated of when the detected temperature reaches the preset temperature, terminating the heating.

3. Decision Manner of Position in Heating Chamber at which Food Item is Placed

Here, how the position in heating chamber 10 at which the food item is placed is decided in the initial search is described.

Figure 12:
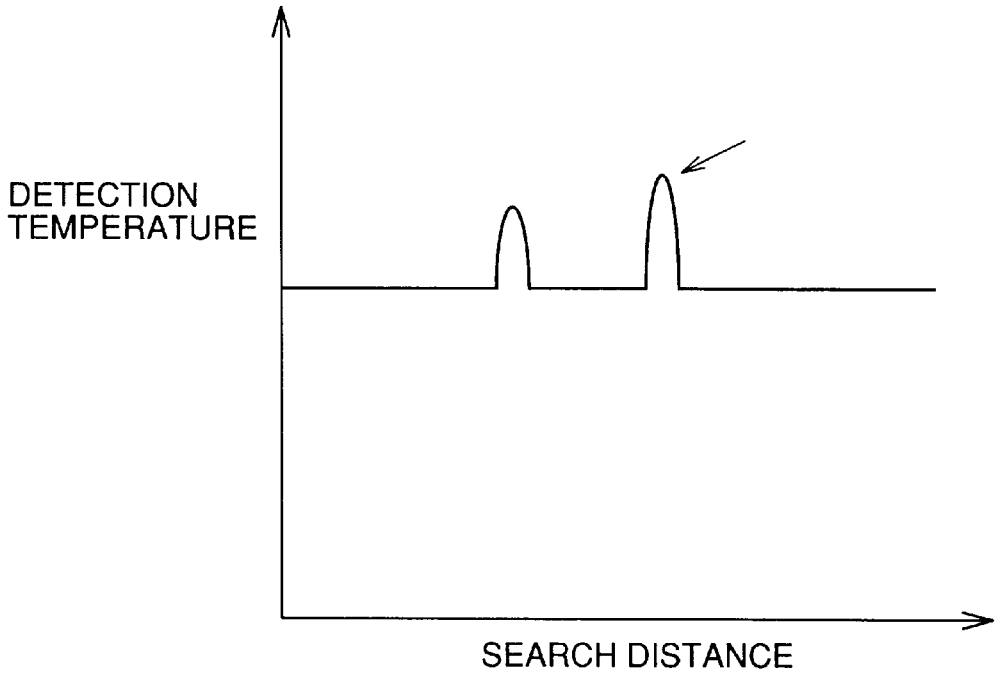
FIG. 12 shows an example of a detection temperature based on the detection output of the infrared sensor relative to the distance of movement (search distance) in an initial search in the microwave oven shown in FIG. 1.

In FIG. 12, a plurality of peaks in the detected temperature can be seen relative to the distance of the movement of the field of view. Such peaks appear because the temperature within the field of view of infrared sensor 7 is higher when the field of view of infrared sensor 7 is at a position that is a search distance, corresponding to a peak, away from a position where the initial search started, compared to when the field of view is elsewhere. Therefore, it is decided that the food item is placed at a position corresponding to the search distance including such a peak.

In microwave oven 1, it is assumed that the food item is placed at a position in heating chamber 10 where the temperature difference relative to the periphery in the heating chamber is maximum. A position where the temperature difference relative to the periphery is equal to or larger than a predetermined value may also be determined as the position having the food item thereat.

In particular, when the plurality of peaks can be found as shown in FIG. 12, it is determined that the food item is placed at a position corresponding to the search distance (the moving distance of the field of view) including a higher peak (the one indicated by the arrow in FIG. 12).

In practice, note that the temperature of the food item is obtained in such a manner that infrared sensor 7 outputs a signal of a voltage value corresponding to the amount of the detected infrared radiation, and the voltage value of the signal is converted into the detection temperature as shown in FIG. 12.

Further, in the detection temperature shown in FIG. 12, a reference temperature, i.e. the temperature of a position other than the peak positions, can be assumed as the average temperature of the locations without the food item on bottom plate 9. Such a temperature is hereinafter referred to as "shelf temperature."

Note that it is unnecessary for the temperature of the food item placed in heating chamber 10 to always be higher than the shelf temperature. For example, when a food item just taken out of a refrigerator is placed in heating chamber 10 as an object to be heated, it is generally assumed that the temperature of the food item is lower than the shelf temperature.

Figure 13:
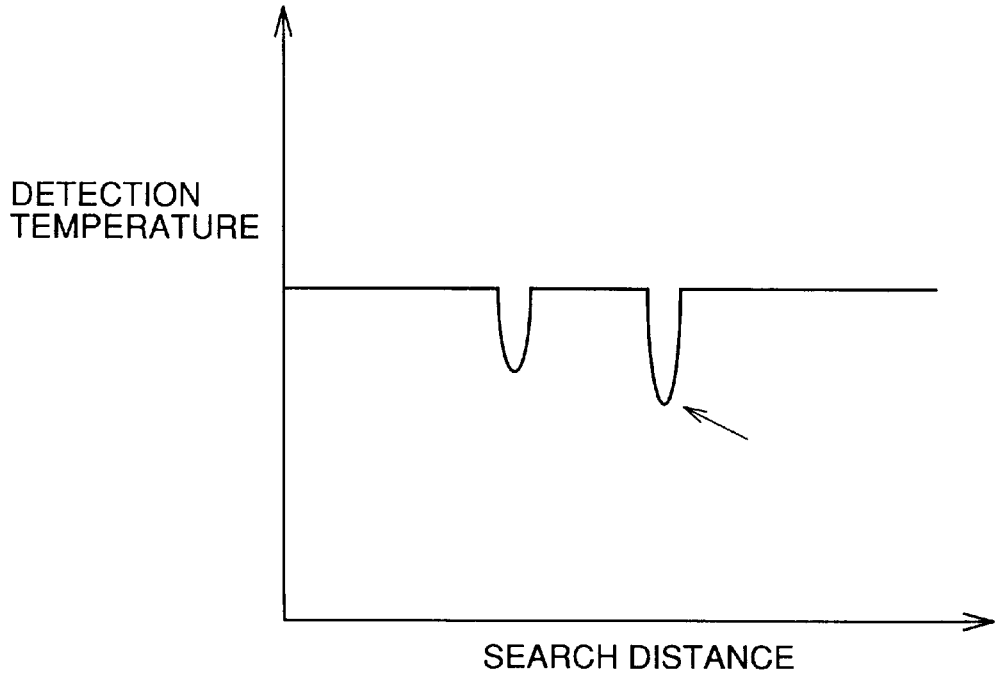
FIG. 13 shows another example of a detection temperature based on the detection output of the infrared sensor relative to the distance of movement (search distance) in an initial search in the microwave oven shown in FIG. 1.

When the temperature of the food item is lower than the shelf temperature, the peak values are lower than the shelf temperature as shown in FIG. 13 at the time of the initial search. In such a case, it is also determined that the food item is placed at a position corresponding to a search distance including a peak. Further, when a plurality of peaks are found, it is determined that the food item is placed at a position corresponding to the search distance including the peak having a higher value (the one indicated by the arrow in FIG. 13).

It is noted that, when a peak having a temperature higher than the shelf temperature and a peak having a temperature lower than the shelf temperature appeared in the initial search, it is determined that the food item is placed at a position corresponding to the search distance including one of the above peaks having a larger absolute value of the difference between the temperature at the peak and the shelf temperature.

Note that the shelf temperature may not necessarily be the reference temperature of the detection temperature as shown in FIGS. 12 and 13. For example, the temperature at a position that is hardly considered to include the food item may also be defined as the shelf temperature.

4. Control Manner for Moving the Field of View

The control manner for moving the field of view in each cooking menu shown in Table 1 will now be described in more detail with reference to FIGS. 14 to 18.

(1) Sake/Milk Heating Process

Figure 14:
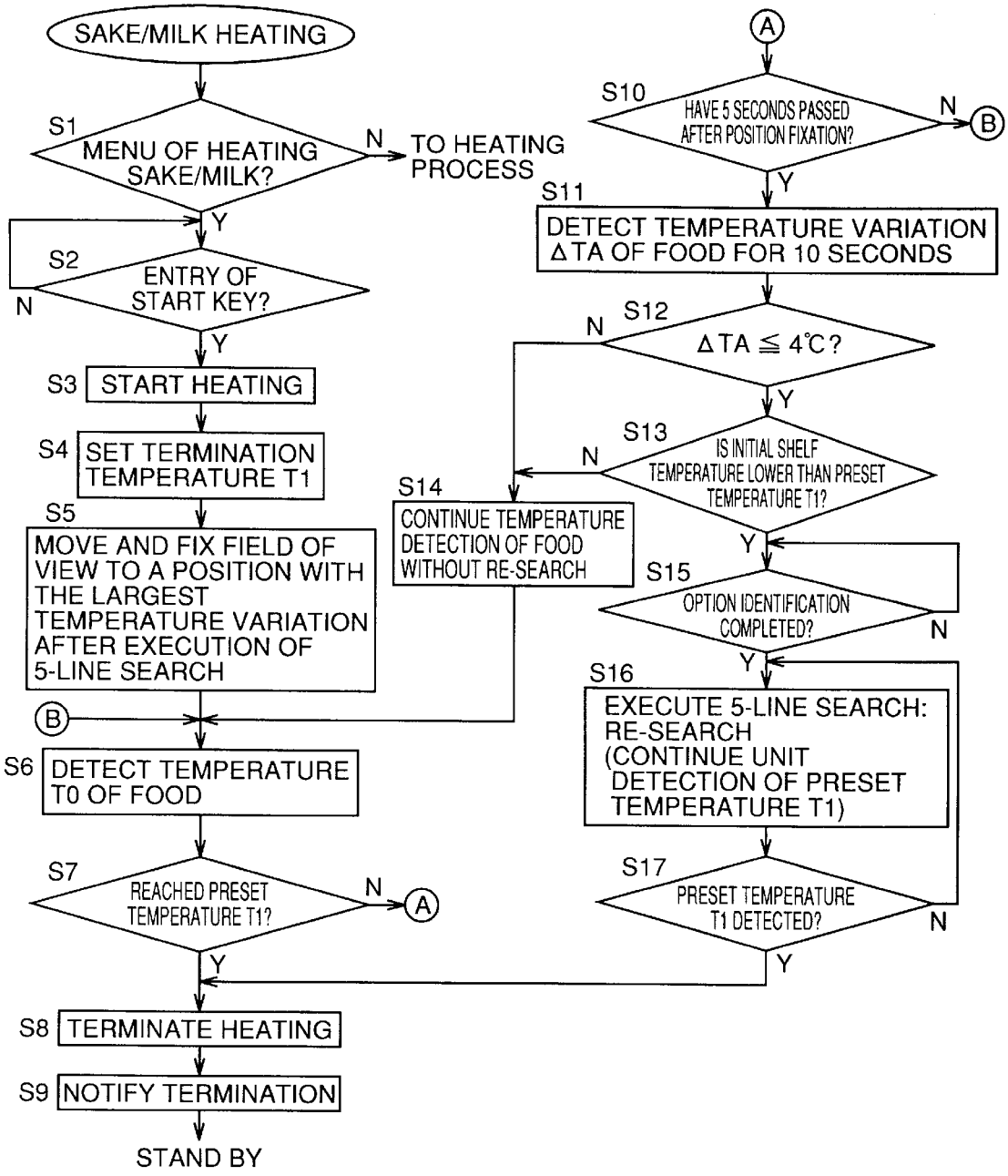
FIG. 14 is a flowchart of a sake/milk heating process executed by a control circuit in the microwave oven shown in FIG. 1.

The sake/milk heating process shown in FIG. 14 is the process carried out when the cooking menu of the "sake/milk heating" is executed in microwave oven 1. Note that the cooking menu of the sake//milk heating is for heating a food item contained in a relatively tall container.

When some operation is performed on operation panel 6, control circuit 90 determines in S1 whether or not the operation was to request the execution of the cooking menu of the sake/milk heating. Then, if it is determined that the operation was to request the execution of the cooking menu, the process will be moved on to S2, whereas if it is determined otherwise, the heating process shown in FIG. 15 will be executed.

In S2, control circuit 90 determines whether or not the key for starting the heating process in accordance with the cooking menu requested for execution (hereinafter simply referred to as a "start key") was operated. If it is determined that the start key was operated, the process is moved on to S3.

In S3, control circuit 90 starts the heating operation by magnetron 12.

Subsequently, in S4, control circuit 90 sets a preset temperature T1 in accordance with the cooking menu under execution. Note that the preset temperature is the temperature at which the heating by magnetron 12 is terminated when the temperature determined based on the detection output of infrared sensor 7 reaches this temperature. Further, the temperature is determined based on the voltage value output from infrared sensor 7. Specifically, infrared sensor 7 outputs a voltage value representing the difference between the temperature within the field of view and the reference temperature, and control circuit 90 converts the voltage value into the temperature difference to be used for detection of the temperature. More specifically, control circuit 90 converts, for example, the voltage value of 80 mV output from infrared sensor 7 into the temperature difference of 4° C., the voltage value of 100 mV into the temperature difference of 5° C., the voltage value of 150 mV into the temperature difference of 7° C., the voltage value of 200 mV into the temperature difference of 10° C., and the voltage value of 280 mV into the temperature difference of 14° C.

Next, in S5, control circuit 90 moves the field of view of infrared sensor 7 in accordance with the five-line search (see FIG. 8) as an initial search, and then fixes the field of view at a position where the largest difference was attained between the temperature at the position and the shelf temperature. Note that the food item is considered to have been placed within the fixed field of view.

Subsequently, in S6, control circuit 90 detects the temperature of the object within the fixed field of view (T0) based on the detection output of infrared sensor 7.

Next, in S7, control circuit 90 determines whether or not T0 has reached T1. If it is determined that T0 has reached T1, control circuit terminates the heating in S8 and subsequently notifies in S9 that the heating is terminated, to enter the standby state. One the other hand, if it is determined otherwise, the process is moved on to S10.

In S10, control circuit 90 determines whether or not five seconds have passed since the position of the field of view was fixed in S5. If it is determined that five seconds have not yet passed, control circuit returns the process back to S6, and if it is determined otherwise, it moves the process on to S11.

In S11, control circuit 90 detects a variation ΔTA of the temperature of the object within the field of view for 10 seconds from the time point at which the process in S11 was started.

Subsequently, in S12, control circuit 90 determines whether or not ΔTA detected in S11 is equal to or lower than 4° C. If it is determined that ΔTA is equal to or lower than 4° C., the process is moved on to S13, and if it is determined that ΔTA exceeds 4° C., the process is moved on to S14.

In S13, control circuit 90 determines whether or not the shelf temperature at the time of the initial search in S5 is lower than the preset temperature of T1. If it is determined that the shelf temperature is lower than T1, the process goes on to S15, whereas if it is determined the shelf temperature is equal to or higher than T1, the process goes on to S14.

In S14, control circuit 90 continues detection of the temperature of the food item while continuously fixing the field of view as fixed in the initial search, performing no re-search, and then the process is returned back to S6.

Further, in S15, control circuit 90 determines whether or not option identification is entirely completed. The option identification means that an option to be used for executing the cooking is identified in the cooking menu under execution. It is noted that there are a plurality of options for each cooking menu in microwave oven 1. An option is identified in accordance with, for example, the amount of the food item, and the preset temperature T1 may be corrected depending on the identified option. If it is determined that the option identification has been completed, the process goes on to S16.

In S16, control circuit 90 moves the field of view of infrared sensor 7 in accordance with the five-line search as a re-search. During the re-search, the temperature of the object within the field of view is continuously detected. Subsequently, if control circuit 90 determines in S17 that the temperature equal to or higher than T1 is detected as the detection temperature, terminates the heating operation as well as the movement of the field of view in S8 and notifies in S9 that the heating operation is terminated, to enter the standby state. It is noted that the re-search in S16 is continued until it is determined in S17 that the temperature equal to or higher than T1 is detected.

In the sake/milk heating process described above, if the temperature variation of the object within the field of view is equal to or lower than a specified value (4° C.) after a predetermined time (10 seconds) has passed since the field of view was fixed as a result of the initial search, the re-search will be executed.

Thus, even if the field of view was once fixed at a position where no food item was placed for some reason in the initial search, the field of view would not be fixed at the incorrect position, but rather can be moved again.

It is noted that, in the sake/milk heating process, if no raise is observed in the temperature within the field of view to exceed the predetermined temperature within the predetermined time, it is determined that the food item may not be placed in the field of view fixed in the initial search. This means that microwave oven 1 is particularly advantageous when a portion on bottom plate 9 in heating chamber 10 has a relatively large temperature difference between the portion and the periphery thereof due to, for example, the effect of the object that had been placed before the cooking started. This is because the present embodiment can avoid the situation associated with the conventional microwave oven where such a portion would be misidentified to include the food item and the temperature variation of that portion would continuously be detected during the cooking period.

Further, in the sake/milk heating process, the heating operation is terminated in the re-search at the time point where the temperature equal to or higher than the preset temperature T1 is detected as the temperature of the object within the field of view.

Though the preset temperature T1 at which the heating should be terminated was set in the sake/milk heating process, a stage-changing temperature TN may be set when the heating is executed in multi-stages in microwave oven 1, as a temperature at which one stage proceeds to the next stage in the multi-stages. In such a case, if it is determined in S7 or S17 that the stage-changing temperature TN is detected, control circuit 90 will not terminate the heating but rather will move the process to the next heating stage. An example of the cooking in the multi-stages is such that a food item is heated by magnetron 12 to a certain temperature and thereafter is heated by heaters 13, 14.

(2) Heating Process

Figure 15:
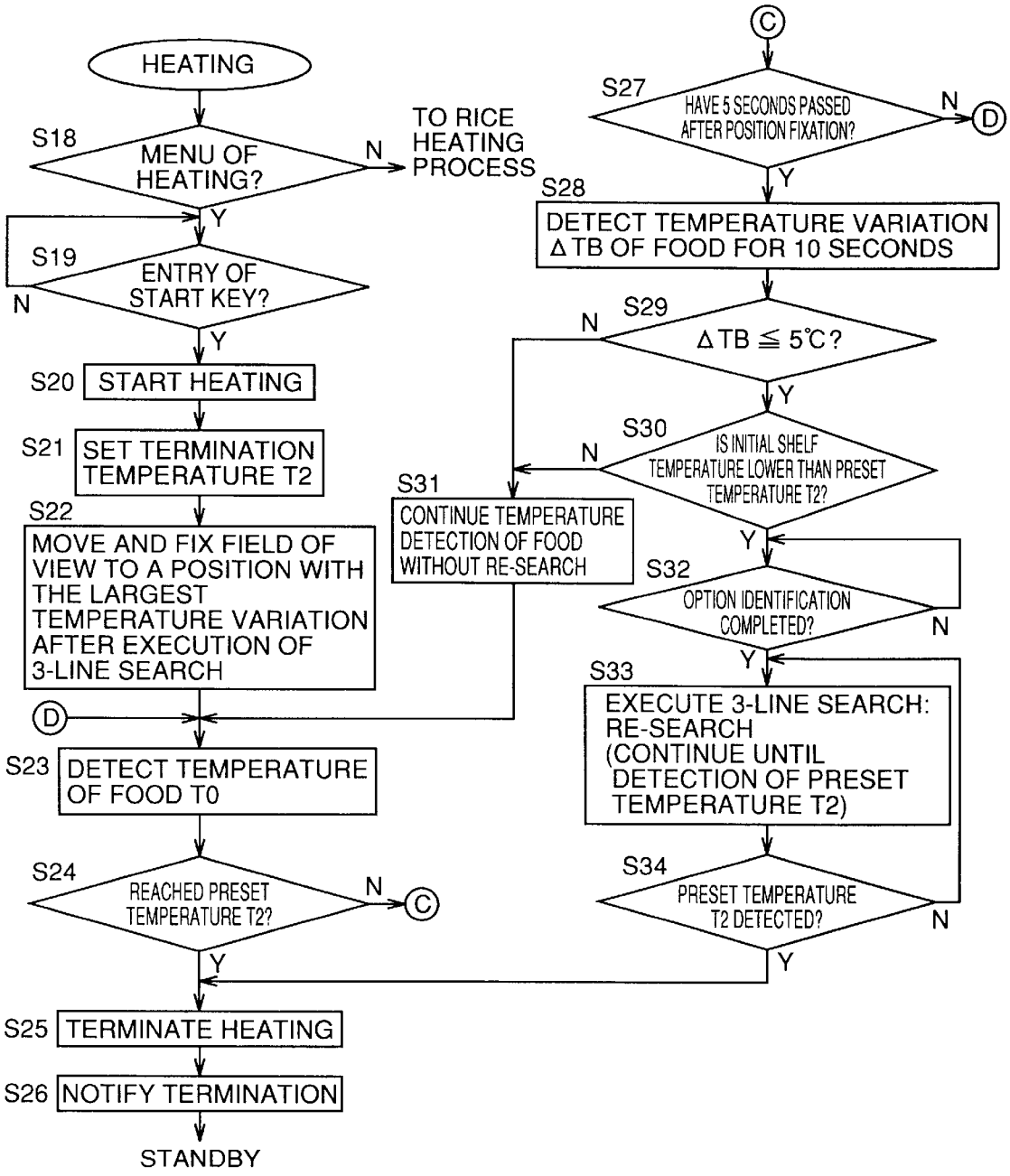
FIG. 15 is a flowchart of a heating process executed by the control circuit in the microwave oven shown in FIG. 1.

The heating process shown in FIG. 15 is the process performed when the cooking menu of "heating" is executed in microwave oven 1. It is noted that the heating process is for heating a food item contained in a relatively shallow container compared to that used in the cooking menu of the sake/milk heating.

When it is determined in S1 (see FIG. 14) that the process is moved on to the heating process, control circuit 90 first determines in S18 if the operation was to request the execution of the cooking menu of the heating. If it is determined that the operation was to request the execution of the cooking menu, the process goes on to S19, whereas if it is determined otherwise, the rice heating process shown in FIG. 16 will be executed.

In S19, control circuit 90 determines whether or not an entry by the start key is identified, and if it is determined that the entry is identified, control circuit 90 moves the process on to S20.

In S20, control circuit 90 starts the heating operation by magnetron 12.

Next, in S21, control circuit 90 sets a preset temperature T2 in accordance with the cooking menu under execution.

Subsequently, in S22, control circuit 90 moves the field of view of infrared sensor 7 in accordance with the three-line search (see FIG. 9) as an initial search, and thereafter fixes the field of view at a position having the largest difference between the temperature at that position and the shelf temperature. In this case, it is assumed that the food item is placed within the fixed field of view.

Subsequently, in S23, control circuit 90 detects the temperature (T0) of the object within the fixed field of view based on the detection output of infrared sensor 7.

Subsequently, in S24, control circuit 90 determines whether or not T0 has reached T2. If it is determined that T0 has reached T2, control circuit 90 terminates the heating in S25, and then notifies in S26 that the heating is terminated, to enter the standby state. Whereas, if it is determined that T0 has not yet reached T2, the process is moved on to S27.

In S27, control circuit 90 determines whether or not five seconds have passed since the position of the field of view was fixed in S22. The process is moved back to S23 if it is determined that five seconds have not yet passed, whereas it is moved on to S28 if it is determined otherwise.

In S28, control circuit 90 detects a variation ΔTB of the temperature of the object within the field of view for 10 seconds from the time point at which the process in S28 was started, and moves the process on to S29.

In S29, control circuit 90 determines whether or not ΔTB detected in S28 is equal to or lower than 5° C. If it is determined that ΔTB is equal to or lower than 5° C., the process is moved on to S30, whereas if it is determined that ΔTB exceeds 5° C., the process is moved on to S31.

In S30, control circuit 90 determines whether or not the shelf temperature at the time of the initial search in S22 is lower than the preset temperature T2. If it is determined that the shelf temperature is lower than T2, the process goes on to S32, whereas if it is determined that the shelf temperature is equal to or higher than T2, the process goes on to S31.

In S31, control circuit 90 continues the detection of the temperature of the food item with the field of view still fixed as fixed in the initial search, not performing the re-search, and returns the process back to S23.

Further, in S32, control circuit 90 determines whether or not the option identification is entirely completed for the menu of the heating. If it is determined that the option identification is completed, the process is moved on to S33.

In S33, control circuit 90 moves the field of view of infrared sensor 7 in accordance with the three-line search as a re-search. The temperature of the object within the field of view is continuously detected during the re-search. If control circuit 90 determines in S34 that the temperature equal to or higher than T2 was detected as the detection temperature, it terminates the heating operation as well as the movement of the field of view in S25, and notifies in S26 that the heating operation is terminated, to enter the standby state. It is noted that the re-search in S33 is continued until it is determined that the temperature equal to or higher than T2 is detected in S34.

In the heating process described above, if the temperature variation of the object within the field of view is equal to or lower than a specified value (5° C.) after a predetermined time (10 seconds) has passed since the field of view was fixed as a result of the initial search, the re-search will be executed.

It is noted that the specified value (5° C.) that is the reference for determination in the execution of the re-search is different from the specified value (4° C.) used in S12 of the sake/milk heating process described with reference to FIG. 14. This means that the specified value of the determination reference in the execution of the re-search can be set to a different value per cooking menu. Furthermore, the predetermined time that is the reference for determination in the execution of the re-search can also be set to a different time per cooking menu.

In the heating process, if no raise in the temperature exceeding the predetermined temperature is observed in the field of view within the predetermined time, it is determined that no food item is placed within the field of view fixed in the initial search.

Further, in the heating process, the heating operation is terminated at the time point where the temperature equal to or higher than the preset temperature T2 is detected as the temperature of the object within the field of view during the re-search.

(3) Rice Heating Process

Figure 16:
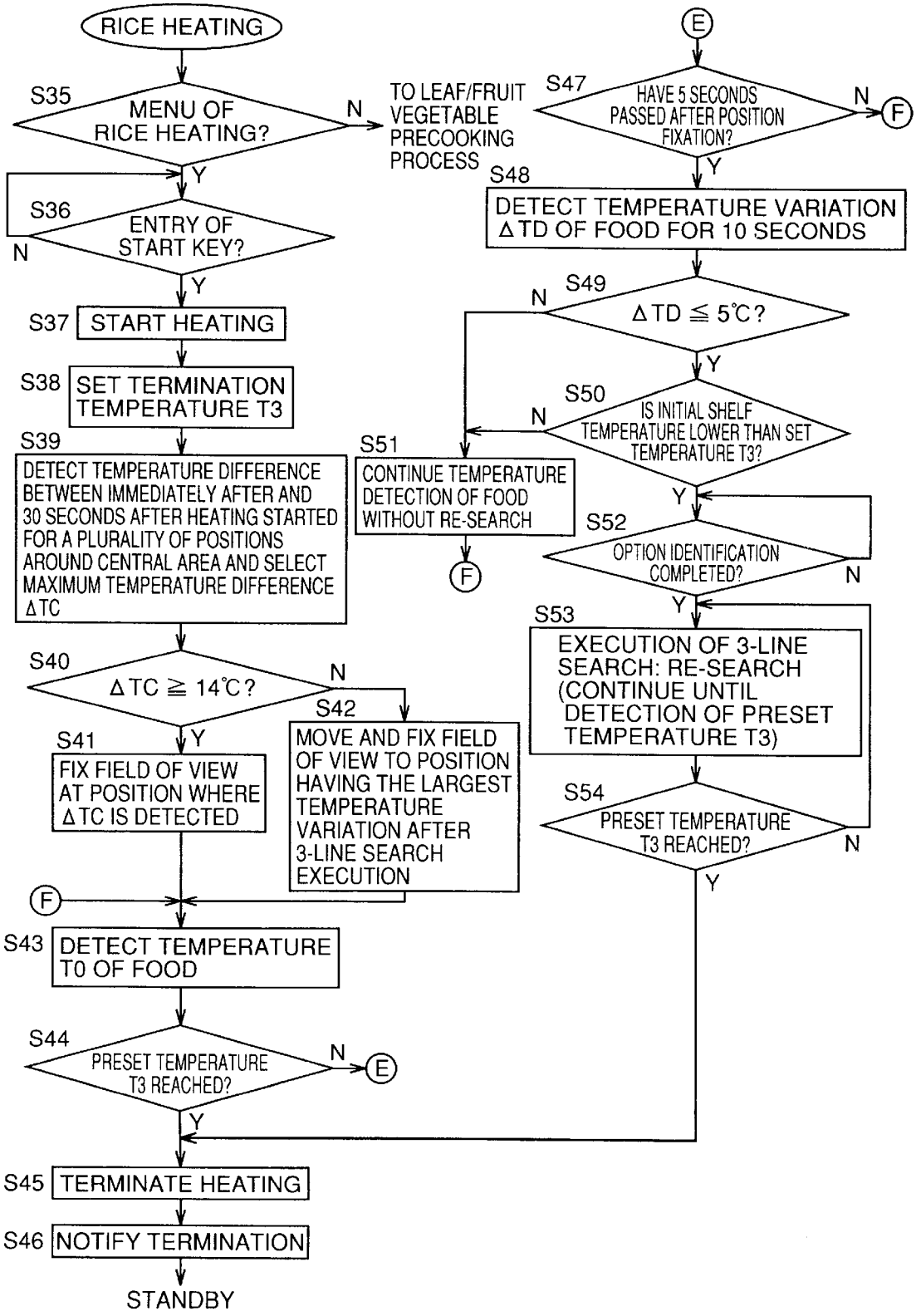
FIG. 16 is a flowchart of a rice heating process executed by the control circuit in the microwave oven shown in FIG. 1.

The rice heating process shown in FIG. 16 is the process performed when the cooking menu of "rice" is executed in microwave oven 1. It is noted that the cooking menu of rice is for heating rice contained in a ball as an object to be heated.

When it is determined in S18 (see FIG. 15) that the process is moved on to the rice heating process, control circuit 90 first determines in S35 whether or not the operation was to request the execution of the cooking menu of rice heating. If it is determined that the operation was to request the execution of that cooking menu, the process is moved on to S36, whereas if it is determined otherwise, the process for leaf/fruit vegetable shown in FIG. 17 will be executed.

In S36, control circuit 90 determines whether or not the entry of the start key was identified, and if it is determined that the entry was identified, the process is moved on to S37.

In S37, control circuit 90 starts the heating operation by magnetron 12.

Next, in S38, control circuit 90 sets a preset temperature T3 in accordance with the cooking menu under execution.

Subsequently, in S39, control circuit 90 moves the field of view of infrared sensor 7 in accordance with the central area search (see FIG. 10) as an initial search, and thereafter stores a position having the largest difference between the temperature at that position and the shelf temperature, and the temperature difference ΔTC.

Subsequently, in S40, control circuit 90 determines whether or not ΔTC, i.e. the difference between the shelf temperature and the temperature detected at the position where the field of view is fixed that are stored in S39, is equal to or higher than 14° C. If it is determined that ΔTC is equal to or higher than 14° C., the process goes on to S41, whereas if it is determined that ΔTC is lower than 14 ° C., the process goes on to S42.

In S41, control circuit 90 fixes the field of view at the position stored in S39. Further, in S42, control circuit 90 again moves the field of view of infrared sensor 7 in accordance with the three-line search, and thereafter fixes the field of view at a position with the largest difference between the temperature at that position and the shelf temperature in the three-line search.

Next, in S43, control circuit 90 detects the temperature of the object within the fixed field of view (T0) based on the detection output of infrared sensor 7.

Subsequently, in S44, control circuit 90 determines whether or not T0 has reached T3. If it is determined that T0 has reached T3, control circuit 90 terminates the heating in S45, and notifies in S46 that the heating has been terminated, to enter the standby state. On the other hand, if it is determined that T0 has not yet reached T3, the process is moved on to S47.

In S47, control circuit 90 determines whether or not five seconds have passed since the position of the field of view was fixed in S41 or S42. If it is determined that five seconds have not yet been passed, the process goes back to S43, whereas if it is determined otherwise, the process goes on to S48.

In S48, control circuit 90 detects a variation ΔTD of the temperature of the object within the field of view for 10 seconds from the time point at which the process in S48 started.

Next, in S49, control circuit 90 determines whether or not ΔTD detected in S48 is equal to or lower than 5° C. If it is determined that ΔTD is equal to or lower than 5° C., the process goes on to S50, whereas if it is determined that ΔTD exceeds 5° C., the process goes on to S51.

In S50, control circuit 90 determines whether or not the shelf temperature at the time of the initial search in S39 is lower than the preset temperature T3. If it is determined that the shelf temperature is lower than T3, the process goes on to S52, whereas if the shelf temperature is equal to or higher than T3, the process goes on to S51.

In S51, control circuit 90 performs no re-search, but rather continues detection of the temperature of the food item while fixing the field of view as fixed in the initial search (in S41 or S42), and returns the process back to S43.

Further, in S52, control circuit 90 determines whether or not the identification of options has been completed for the rice heating menu. If it is determined that the identification of the options has been completed, the process goes on to S53.

In S53, control circuit 90 moves the field of view of infrared sensor 7 in accordance with the three-line search as a re-search. During the re-search, temperature of the object within the field of view is continuously detected. If control circuit 90 determines in S54 that the temperature equal to or higher than T3 is detected as the detection temperature, it terminates the heating operation as well as the movement of the field of view in S45, and notifies the termination of the heating operation in S46, to enter the standby state. It is noted that the re-search in S53 is continued until it is determined in S54 that the temperature equal to or higher than T3 is detected.

In the rice heating process described above, first, the central area search is carried out in S39, and then if it is determined that the maximum temperature difference TC relative to the shelf temperature in the central area search is lower than 14° C. in S40, the three-line search is conducted in S42. Note that the determination that TC is lower than 14° C. in S40 means that no food item is placed at the position detected by the central area search. That is, in the processes of S39 to S42, the central area search is first conducted, and if the field of view cannot be moved to the position including the food item as a result of the central area search, the three-line search will further be conducted. In the rice heating process, the processes of S39 to S42 corresponds to an initial search.

Moreover, in the rice heating process described above, if the temperature variation of the object within the field of view is equal to or lower than the specified value (5° C.) after the predetermined time (10 seconds) have passed since the field of view was fixed as a result of the initial search, the re-search will be executed. At that time, only the three-line search is conducted as a re-search.

Therefore, in the rice heating process described above, the initial search and the re-search are different from each other in the movement manner of the field of view.

(4) Leaf/Fruit Vegetable Precooking Process

Figure 17:
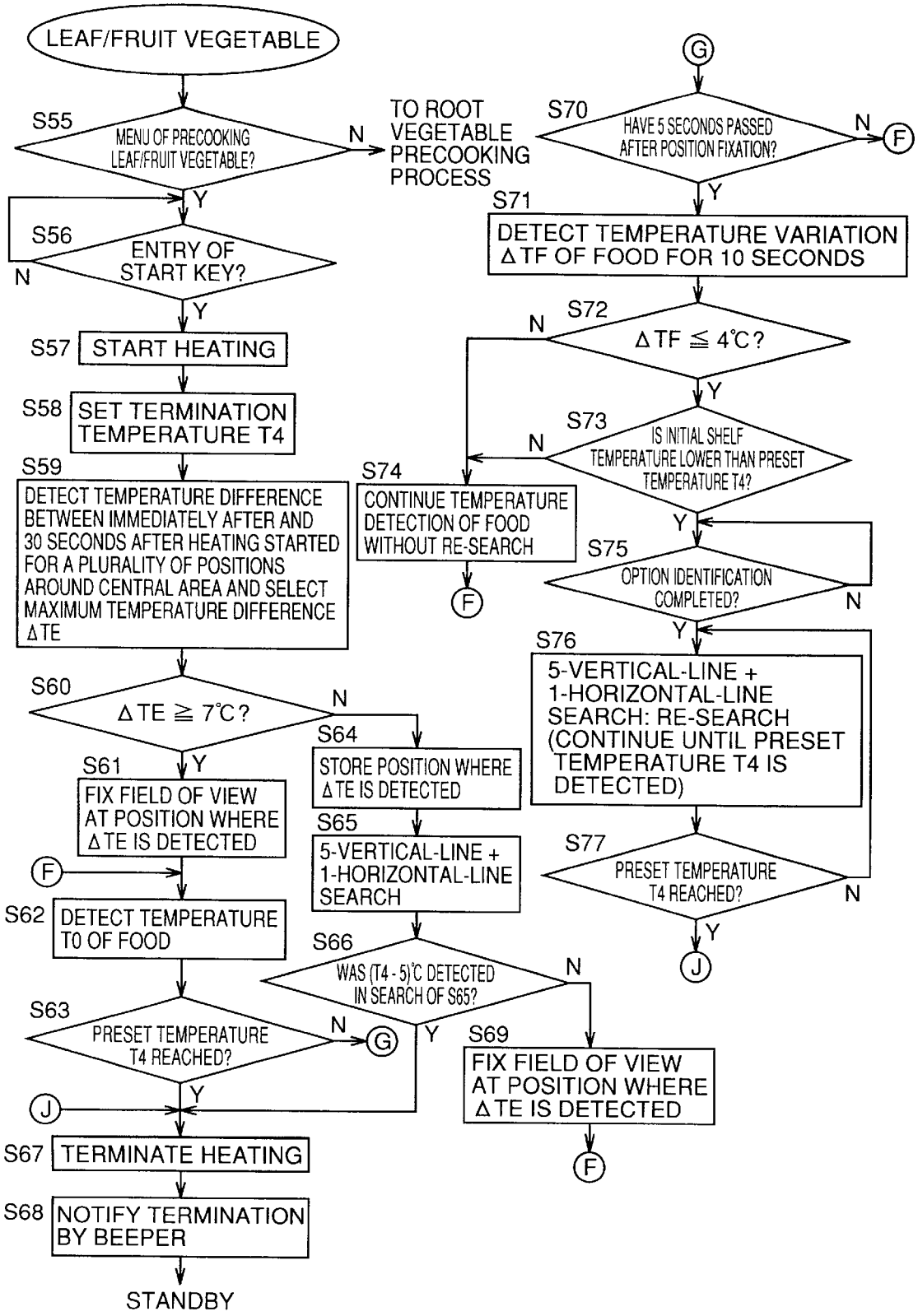
FIG. 17 is a flowchart of a leaf/fruit vegetable precooking process executed by the control circuit in the microwave oven shown in FIG. 1.

The leaf/fruit vegetable precooking process shown in FIG. 17 is the process performed when the cooking menu of "leaf/fruit vegetable," i.e. the precooking of leaf vegetable or fruit vegetable, is executed in microwave oven 1.

When it is determined that the process is moved on to the leaf/fruit vegetable precooking process in S35 (see FIG. 16), control circuit 90 first determines whether or not the operation was to request the execution of the cooking menu of the leaf/fruit vegetable in S55. If it is determined that the operation was to request the execution of that cooking menu, the process is moved on to S56, whereas if it is determined otherwise, the process for root vegetable shown in FIG. 18 will be executed.

In S56, control circuit 90 determines whether or not the entry of the start key was identified, and if it is determined that the entry was identified, the process goes on to S57.

In S57, control circuit 90 starts the heating operation by magnetron 12.

Next, in S58, control circuit 90 sets a preset temperature T4 in accordance with the cooking menu under execution.

Subsequently, in S59, control circuit 90 moves the field of view of infrared sensor 7 in accordance with the central area search (see FIG. 10) as an initial search, and thereafter stores a position with the largest difference between the temperature at that position and the shelf temperature in the central area search, and the temperature difference ΔTE.

Subsequently, in S60, control circuit 90 determines whether or not ΔTE, i.e. the difference between the shelf temperature and the temperature detected at the position where the field of view is fixed, stored in S59, is equal to or higher than 7° C. If it is determined that ΔTE is equal to or higher than 7° C., the process is moved on to S61, and if it is determined that ΔTE is lower than 7° C., the process is moved on to S64.

In S61, control circuit 90 fixes the field of view at the position stored in S59, and moves the process on to S62.

Furthermore, in S64, control circuit 90 again moves the field of view of infrared sensor 7 in S65 by the five-vertical-line+one-horizontal-line search (see FIG. 11), while still storing the position stored in S59. Thereafter, control circuit 90 determines in S66 whether or not the temperature equal to or higher than (T4–5)° C. is detected during the five-vertical-line+one-horizontal-line search in S65, and if it is determined that the temperature is detected, moves the process on to S67, whereas if it is determined otherwise, moves the process on to S69. In S69, the field of view is fixed at the position where ΔTE is detected, which was stored in S59 and S64, and the process is returned back to S62.

In S62, control circuit 90 detects the temperature of the object within the fixed field of view (T0) based on the detection output of the infrared sensor 7.

Next, in S63, control circuit 90 determines whether or not T0 has reached T4. If it is determined that T0 has reached T4, control circuit 90 terminates the heating in S67, and notifies in S68 that the heating has been terminated, to enter the standby state. On the other hand, if it is determined that T0 has not yet reached T4, the process goes on to S70.

In S70, control circuit 90 determines whether or not five seconds have passed since the position of the field of view was fixed in S61 or S69. If it is determined that five seconds have not yet passed, the process goes back to S62, whereas if it is determined otherwise, the process goes on to S71.

In S71, control circuit 90 detects a variation ΔTF of the temperature of the object within the field of view for 10 seconds from the time point at which the process of S71 started.

Next, in S72, control circuit 90 determines whether or not ΔTF detected in S71 is equal to or lower than 4° C. If it is determined that ΔTF is equal to or lower than 4° C., the process is moved on to S73, whereas if it is determined that ΔTF exceeds 4° C., the process is moved on to S74.

In S73, control circuit 90 determines whether or not the shelf temperature at the time of the search in S59 is lower than the preset temperature T4. If it is determined that the shelf temperature is lower than T4, the process is moved on to S75, and if it is determined that the shelf temperature is equal to or higher than T4, the process is moved on to S74.

In S74, control circuit 90 performs no re-search, but rather continues detection of the temperature of the food item while fixing the field of view as fixed in the initial search (in S61 or S69), and moves the process back to S62.

Further, in S75, control circuit 90 determines whether or not the identification of options has completed for the leaf/fruit vegetable precooking menu. If it is determined that the identification of options has been completed, the process is moved on to S76.

In S76, control circuit 90 moves the field of view of infrared sensor 7 in accordance with the five-vertical-line+one-horizontal-line search as a re-search. During this re-search, the temperature of the object within the field of view is continuously detected. If control circuit 90 determines in S77 that the temperature equal or higher than T4 is detected as the detection temperature, it terminates the heating operation as well as the movement of the field of view in S67, and notifies the termination of the heating operation in S68, to enter the standby state. It is noted that the re-search in S76 is continued until it is determined that the temperature equal to or higher than T4 is detected in S77.

In the leaf/fruit vegetable precooking process described above, first, the central area search is conducted in S59, and if it is determined that the maximum temperature difference TE relative to the shelf temperature in the central area search is lower than 7° C. in S60, then the five-vertical-line+one-horizontal-line search will be conducted in S65. It is noted that the determination that TE is lower than 7° C. in S60 means that no food item is placed at the position detected by the central area search. Thus, in the processes of S59, S60, S64 and S65, the central area search is first conducted, and if the field of view cannot be moved to the position where the food item is placed by that central area search, the five-vertical-line+one-horizontal-line search will further be conducted. In the leaf/fruit vegetable precooking process, the processes of S59, S60, S64 and S65 correspond to an initial search.

(5) Root Vegetable Precooking Process

Figure 18:
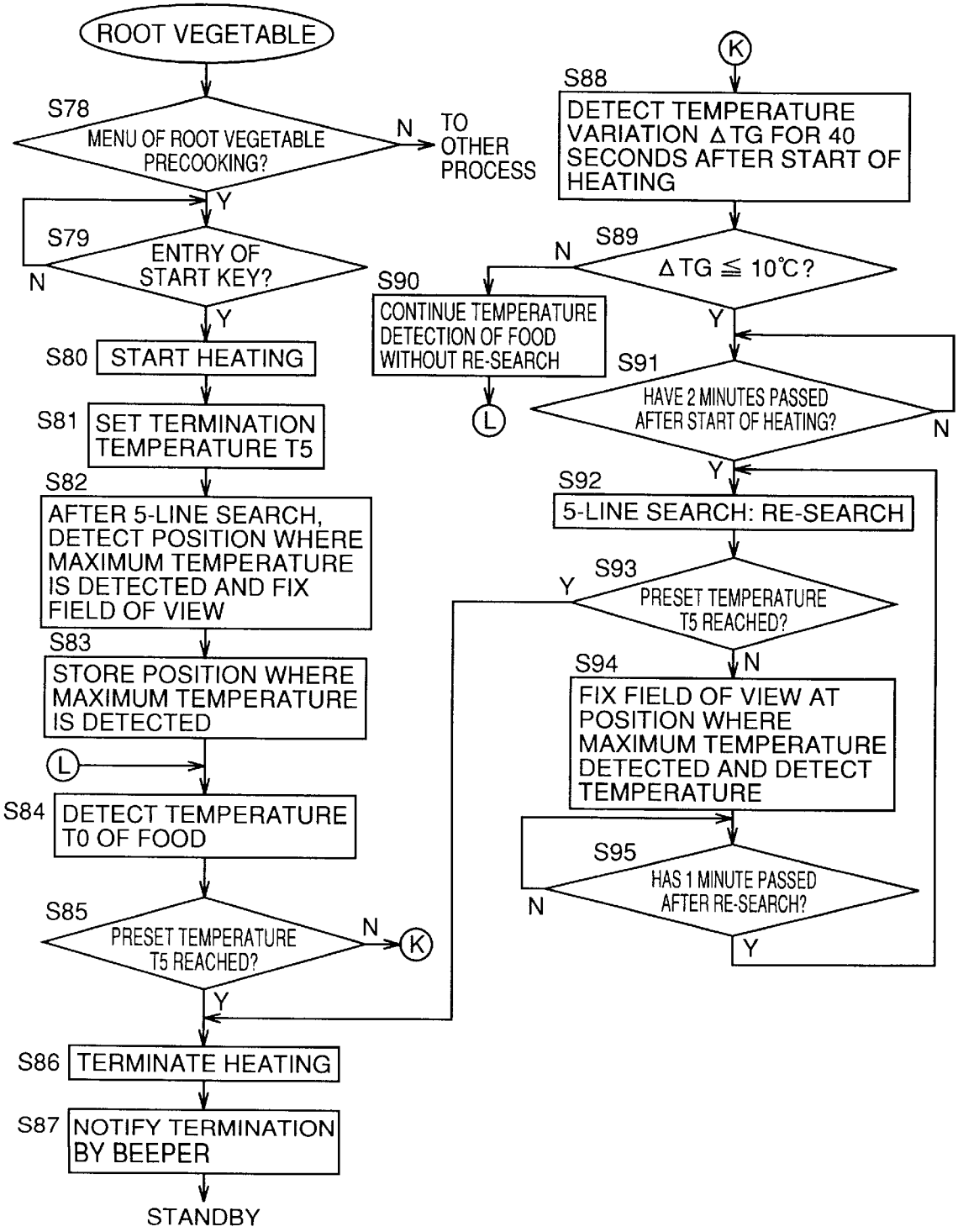
FIG. 18 is a flowchart of a root vegetable precooking process executed by the control circuit in the microwave oven shown in FIG. 1.

The root vegetable precooking process shown in FIG. 18 is a process performed when the cooking menu of "root vegetable" is executed in microwave oven 1. It is noted that the cooking menu of root vegetable is for precooking root vegetable.

When it is determined that the process is moved on to the root vegetable precooking process in S55 (see FIG. 17), control circuit 90 first determines in S78 if the operation was to request the execution of the cooking menu of root vegetable. If it is determined that the operation was to request the execution of that cooking menu, the process is moved on to S79, and if it is determined otherwise, another process will be executed.

In S79, control circuit 90 determines whether or not the entry of the start key is identified, and if it is determined that the entry is identified, the process goes on to S80.

In S80, control circuit 90 starts the heating operation by magnetron 12.

Next, in S81, control circuit 90 sets a preset temperature T5 in accordance with the cooking menu under execution.

Subsequently, in S82, control circuit 90 moves the field of view of infrared sensor 7 in accordance with the five-line search as an initial search, and thereafter fixes the field of view at a position having the largest difference between the temperature at that position and the shelf temperature. In this case, it is assumed that the food item is placed within the fixed field of view.

Subsequently, in S83, control circuit 90 stores the position which had the largest temperature difference relative to the periphery in S82.

Subsequently, in S84, control circuit 90 detects the temperature of the object within the fixed field of view (T0) based on the detection output of infrared sensor 7.

Subsequently, in S85, control circuit 90 determines whether or not T0 has reached T5. If it is determined that T0 has reached T5, control circuit 90 terminates the heating in S86, and notifies in S87 that the heating has been terminated, to enter the standby state. On the other hand, if it is determined that T0 has not yet reached T5, the process is moved on to S88.

In S88, control circuit 90 detects a variation ΔTG of the temperature of the object within the field of view for 40 seconds from the time point at which the process of S88 started.

Next, in S89, control circuit 90 determines whether or not ΔTG detected in S88 is equal to or lower than 10° C. If it is determined that ΔTG is equal to or lower than 10° C., the process moves on to S90, whereas if it is determined that ΔTG exceeds 5° C., the process moves on to S91.

In S90, control circuit 90 performs no re-search, and continues detection of the temperature of the food item while fixing the field of view as fixed in the initial search, and moves the process back to S84.

In S91, control circuit 90 determines whether or not two minutes have passed since the heating operation started in S80, and moves the process on to S92 at the time point where it is determined that two minutes have passed.

In S92, control circuit 90 moves the field of view of infrared sensor 7 in accordance with the five-line search as a re-search. During the re-search, the temperature of the object within the field of view is continuously detected.

Thereafter, if control circuit 90 determines that the temperature equal to or higher than T5 has been detected as the detection temperature in S93, it terminates the heating operation as well as the movement of the field of view in S86, and notifies the termination of the heating operation in S87, to enter the standby state. On the other hand, in S93, if it is determined that the temperature equal to or higher than T5 has not yet been detected, the process moves on to S94.

In S94, control circuit 90 returns the field of view to the position where the maximum temperature was detected at the time of the initial search, which was stored in S83, and fixes the field of view at that position, and moves the process on to S95.

In S95, it is determined whether or not one minute has passed since the start of the re-search in S92 executed immediately before S95, and if it is determined that one minute has passed, the process is moved back to S92, and five-line search is again conducted.

In the root vegetable precooking process described above, if the temperature variation of the object within the field of view is equal to or lower than the specified value (10° C.) after the predetermined time (40 seconds) has passed since the field of view was fixed as a result of the initial search, the re-search will be executed two minutes after that time point. This means that, in the root vegetable precooking process, the re-search is executed after the specified time (2 minutes and 40 seconds) has passed since the field of view was fixed in the initial search. It is noted that, when a similar process flow is realized for another cooking menu, the time period from the fixation of the field of view in the initial search to the execution of the re-search, the temperature for determination, or the like may be changed per cooking menu.

Moreover, in the root vegetable precooking process, the field of view is returned back to the position stored in S83 every time the five-line search is terminated during the re-search.

Furthermore, in the root vegetable precooking process, one five-line search is executed in S92 every minute during the re-search.

Note that the re-search is executed, in the root vegetable precooking process, until the temperature equal to or higher than the preset temperature T5 is detected as the temperature of the object within the field of view.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A cooking appliance comprising a heating unit heating an object to be heated, a heating chamber containing the object to be heated, and an infrared sensor having a field of view within said heating chamber and detecting an amount of infrared radiation within said field of view, said cooking appliance further comprising:

a field of view moving unit moving the field of view of said infrared sensor; and a temperature detecting unit detecting a temperature of an object within said field of view based on a detection output of said infrared sensor; wherein said field of view moving unit executes a first movement control moving said field of view by a predetermined pattern within said heating chamber simultaneously with or after a start of a heating operation of said heating unit; fixes said field of view at a predetermined position, said predetermined position being one of a position having a temperature difference relative to a periphery equal to or higher than a predetermined value within said heating chamber, and a position having a largest temperature difference relative to the periphery within said heating chamber, in a detection temperature of said temperature detecting unit in said first movement control; and again executes a second movement control moving said field of view within said heating chamber based on satisfaction of a predetermined condition, after fixation of said field of view at said predetermined position.

2. The cooking appliance according to claim 1, wherein said field of view moving unit determines that said predetermined condition is satisfied to execute said second movement control, when the detection temperature of said temperature detecting unit has a variation less than a specified value after a predetermined time has passed since the fixation of said field of view at said predetermined position.

3. The cooking appliance according to claim 2, wherein said heating unit is capable of executing cooking by heat for the object to be heated in accordance with any one of a plurality of cooking menus, and said specified value varies for each of said cooking menus.

4. The cooking appliance according to claim 1, wherein said field of view moving unit determines that said predetermined condition is satisfied to execute said second movement control, when a specified time has passed since the fixation of said field of view at said predetermined position.

5. The cooking appliance according to claim 4, wherein said heating unit is capable of executing cooking by heat for the object to be heated in accordance with any one of a plurality of cooking menus, and said specified time varies for each of said cooking menus.

6. The cooking appliance according to claim 1, further comprising:

a heating control unit controlling the heating operation of said heating unit; wherein said heating control unit has a preset temperature preset for the detection temperature of said temperature detecting unit, said preset temperature being a temperature corresponding to a state where heating of said object to be heated should be terminated; and stops the heating operation of said heating unit at the time point where a temperature equal to or higher than said preset temperature is detected by said temperature detecting unit, when said second movement control is being performed by said field of view moving unit.

7. The cooking appliance according to claim 1, further comprising:

a heating control unit controlling the heating operation of the heating unit so as to allow said heating unit to execute the heating operation in a stepwise manner; wherein said heating control unit has a stage changing temperature preset for the detection temperature of said temperature detecting unit, said stage changing temperature being a temperature corresponding to a state where a heating stage of the heating unit for said object to be heated should be changed; and changes a stage of the heating operation of said heating unit at the time point where a temperature equal to or higher than said stage changing temperature is detected by said temperature detecting unit when said second movement control is being performed by said field of view movement unit.

8. The cooking appliance according to claim 1, wherein said field of view moving unit executes said second movement control every time a certain time period has passed since the fixation of said field of view at said predetermined position.

9. The cooking appliance according to claim 1, wherein said field of view moving unit moves said field of view to said predetermined position every time said second movement control is executed.

10. The cooking appliance according to claim 1, wherein said field of view moving unit moves said field of view by a pattern different from said predetermined pattern in said second movement control.

11. A method of controlling a cooking appliance including a heating unit heating an object to be heated, a heating chamber containing the object to be heated, and an infrared sensor having a field of view within said heating chamber and detecting an amount of infrared radiation within said field of view, said method comprising the steps of:

executing a first movement control moving said field of view by a predetermined pattern in said heating chamber simultaneously with or after a start of a heating operation;

detecting a temperature within said field of view, based on a detection output of said infrared sensor during a period in which said first movement control is being executed;

determining a predetermined position, said predetermined position being one of a position having a temperature difference relative to a periphery equal to or higher than a predetermined value within said heating chamber, and a position having a largest temperature difference relative to a periphery within said heating chamber, in a temperature within said field of view during the period in which said first movement control is being executed;

fixing said field of view at said predetermined position; and executing a second movement control again moving said field of view within said heating chamber, based on satisfaction of a predetermined condition during a period in which said field of view is being fixed at said predetermined position.

12. The method of controlling a cooking appliance according to claim 1, wherein said step of executing said second movement control determines that said predetermined condition is satisfied when a detection temperature of said temperature detecting unit has a variation less than a specified value after fixation of said field of view at said predetermined position.

13. The method of controlling a cooking appliance according to claim 12, wherein said heating unit is capable of executing cooking by heat for an object to be heated in accordance with any one of a plurality cooking menus, and said specified value varies for each of said cooking menus.

14. The method of controlling a cooking appliance according to claim 11, wherein said step of executing said second movement control determines that said predetermined condition is satisfied when a specified time has passed after the fixation of said field of view at said predetermined position.

15. The method of controlling a cooking appliance according to claim 14, wherein said heating unit is capable of executing cooking by heat for an object to be heated in accordance with any one of a plurality of cooking menus, and said specified time varies for each of said cooking menus.

16. The method of controlling a cooking appliance according to claim 11, further comprising the steps of:

setting a preset temperature, said preset temperature being a temperature corresponding to a state where heating of an object to be heated should be terminated; and stopping the heating operation of said heating unit at a time point where a temperature equal to or higher than said predetermined temperature is detected during a period in which said second moving control is being executed.

17. The method of controlling a cooking appliance according to claim 11, further comprising the steps of setting a stage changing temperature, said stage changing temperature being a temperature corresponding to a state where a heating stage of a heating unit for said object to be heated should be changed, and changing a stage of the heating operation of said heating unit at a time point when a temperature equal to or higher than said stage changing temperature is detected by said temperature detecting unit during a period in which said second movement control is being executed.

18. The method of controlling a cooking appliance according to claim 11, wherein said step of executing said second movement control is executed every time a certain time period has passed after the execution of the step of fixing said field of view at said predetermined position.

19. The method of controlling a cooking appliance according to claim 11, further comprising the step of:

moving said field of view to said predetermined position, said step of moving said field of view is executed every time the step of executing said second moving control is executed.

20. The method of controlling a cooking appliance according to claim 11, wherein a movement pattern of said field of view in said second movement control is different from said predetermined pattern.

* * * * *